US005853170A

United States Patent [19]

Achelpohl et al.

[11] Patent Number: 5,853,170

[45] Date of Patent: Dec. 29, 1998

[54] APPARATUS FOR THE TRANSFER OF FLAT WORKPIECES FROM A FIRST CONVEYOR TO A DOWNSTREAM SECOND CONVEYOR

[75] Inventors: Fritz Achelpohl, Lienen; Richard Feldkämper; Andreas Kampschulte, both of Lengerich; Uwe Köhn, Osnabrück, all of Germany

[73] Assignee: Windmöller & Hölscher, Lengerich/Westf., Germany

[21] Appl. No.: 588,356

[22] Filed: Jan. 18, 1996

[30] Foreign Application Priority Data

Jan. 25, 1995 [DE] Germany ..... 195 02 256.4
Mar. 21, 1995 [DE] Germany ..... 195 10 243.6

[51] Int. Cl.[6] ..... B65H 29/68

[52] U.S. Cl. ..... 271/69; 271/307; 198/693

[58] Field of Search ..... 271/69, 306, 307, 271/308, 198; 198/692, 693

[56] References Cited

U.S. PATENT DOCUMENTS 4,027,577 6/1977 Thompson et al. ..... 198/692 X
4,278,383 7/1981 Mueller et al. ..... 198/692 X
4,727,803 3/1988 Nobuta et al. ..... 271/69 X
5,375,827 12/1994 Lentz et al. ..... 271/69 X

*Primary Examiner*—David H. Bollinger
*Attorney, Agent, or Firm*—Evenson, McKeown, Edwards & Lenahan, PLLC

[57] ABSTRACT

An apparatus for the transfer of flat workpieces from a first conveyor to a second conveyor consists of a first conveyor with two endless pulling members circulating parallel to each other over guide wheels or drive wheels which carry in pairs supporting elements with pins. The pins perforating and conveying the workpieces project above a table forming the conveyance path by virtue of the supporting elements and the pins having attachments which run in guides that are parallel to the table and which displace the attachments towards each other. The pulling members of the second conveyor carry in pairs supporting elements with pins which project above a table forming the conveyance path. In the transfer zone of the two conveyors, a plunger is arranged in the frame and mounted in guides. The plunger can be raised and lowered and impales the workpieces onto the pins of the second conveyor. By means of this transfer apparatus, it is possible to convey flat workpieces, in particular those made of a plastic film, through various processing stations. With such an arrangement transition from an intermittent conveying to a continuous conveying is also possible.

12 Claims, 2 Drawing Sheets

APPARATUS FOR THE TRANSFER OF FLAT WORKPIECES FROM A FIRST CONVEYOR TO A DOWNSTREAM SECOND CONVEYOR

FIELD OF THE INVENTION

The invention concerns an apparatus for the transfer of flat workpieces, preferably consisting of a film of plastic material, more preferably sack or bag workpieces, from a first conveyor to a downstream second conveyor, where the first conveyor preferably circulates intermittently and the second conveyor continuously.

PRIOR ART

In manufacturing machines, for example, installations for the manufacture of cross bottom sacks made of a plastic material, it is necessary to transfer the workpieces or sack or bag workpieces from one conveyor to a second conveyor disposed down the line, in order to convey them through successive processing stations where they are worked on while one conveyor is standing still, or during a continuous run. To make it possible to effect an accurate processing of the workpieces or sack or bag workpieces in the individual processing stations, the workpieces have to run at the predetermined times into the processing station in their correct position or pass through them. In this arrangement the conveyance of workpieces of a plastic film basically presents problems since, in contrast to paper for example, they consist of a plastic and elastically yielding material.

OBJECT OF THE INVENTION

It is therefore the object of the invention to create an apparatus of the kind indicated at the outset above, by means of which it is possible to convey flat workpieces of a plastic film through various processing stations, in which arrangement, a transition from an intermittent conveying to a continuous conveying of the workpieces is also possible.

SUMMARY OF THE INVENTION

In accordance with the invention, there is provided an apparatus for the transfer of flat workpieces, from a first conveyor to a second conveyor disposed downstream of the first, conveyor comprising:

(a) a first conveyor and a second conveyor each having two pulling members circulating parallel to each other over guide wheels or sprockets which carry in pairs supporting elements with pins; and at least one supporting plate defining the conveyance path above which the pins project; said first conveyor having guides that are parallel to the table and receive attachments for the supporting elements and pins so as to displace the attachments towards each other as they run in the guides, whereby the pins project from the at least one table to perforate and convey the workpieces; and (b) a plunger arranged in the transfer zone of the two conveyors and mounted in guides so as to be raised and lowered and to impale the workpieces on the pins of the second conveyor as they are transferred from the first conveyor.

The apparatus in accordance with the invention consists of two workpiece-conveying conveyors exerting a form fit on the workpieces, and ensures the transfer of the workpieces in their correct position from the first conveyor to the second conveyor.

The first conveyor, which preferably conveys the workpieces in an intermittent working sequence so that processing can be effected on the workpieces while they are standing still, consists of two endless pulling members circulating parallel to each other over guide wheels or drive wheels and carrying supporting elements in pairs with pins spring loaded in the direction towards their retracted positions. The conveyance path of this first conveyor consists of supporting plates or a table, which may be provided with longitudinal gaps for the penetration of the conveyor elements. The pins perforating and conveying the workpieces project over the conveyance lane formed by the top of the table because the supporting elements and the pins have attachments which run in guides that are parallel to the table and displace the attachments towards each other. Thus while the pins conveying the workpieces run over the table on the conveyance side of the pulling members, the pins are extended so that they convey the workpieces threaded or impaled onto them with a form fit. The first conveyor is followed by a second continuously conveying conveyor with two pulling members circulating parallel to each other over guide wheels or drive wheels and carrying in pairs supporting elements with pins that project over the supporting plates or a table forming the conveyance path, which may likewise be provided with longitudinal gaps. The outlet of the first conveyor and the intake of the second conveyor may overlap one another. In the transfer zone of the two conveyors a plunger, mounted in a rotary guide and rotating approximately at the speed of the second conveyor, is arranged in the frame and is able to be raised and lowered thereby to impale the workpieces onto the pins of the second conveyor. This impaling is necessary to ensure that the pins do also perforate an elastically yielding material of the workpieces. The transfer from the first to the second conveyor is preferably effected at a time when the pins of the first conveyor conveying the workpieces have not yet been retracted, which is effected at a stroke when the supporting elements have left their guides. If the conveyance mode of the first conveyor is intermittent, the transfer is effected during a stage of the working sequence of the first conveyor.

The supporting elements carrying the pins are expediently spring loaded in the direction towards their retracted positions.

The plunger, which is arranged in the transfer zone of the two conveyors on the frame which can be raised and lowered in guides and thereby impales the workpieces onto the pins of the second conveyor, expediently rotates approximately at the speed of the second conveyor.

In a further development of the invention, the pins of the first conveyor may be carried for axial displacement in a bush, the rear end of the pins passing through the bush may carry a disk, and the bush may carry a collar which, in the pushed together positions of the disk and collar extending the pins, are held in mutually parallel grooves of the guides.

To ensure a simple entry of the bushes into the guides, the guides can be provided with funnel-shaped entry parts of the groove which displace the attachments or disks and collars towards each other until they run into the mutually parallel guide sections of the grooves.

The pulling members expediently consist of plate link chains, and the supporting elements may be connected to plates by means of angle pieces. The rollers or connecting components of the plate link chains may run over guides, for example supporting sections, that are fixed to the frame. They may also be carried in groove-shaped guides of the frame.

The rotary guide for the plunger is expediently a rotary disk. For retracting and extending the plunger a pneumatic cylinder may be provided for moving the plunger at a stroke towards the conveyance table when the workpiece has to be impaled on the pins of the second conveyor.

At its end, the plunger may be provided with a recess or a groove into which the pin can penetrate. The rotary disk is expediently provided over at least a part of its circumference with a groove that lies in the radial plane of the recess of the plunger.

BRIEF DESCRIPTION OF THE DRAWINGS

An example of the embodiment of the invention will be described below in greater detail with reference to the accompanying drawings, in which.

DETAILED DESCRIPTION OF THE PREFERRED EMBODIMENTS

Figure 1:
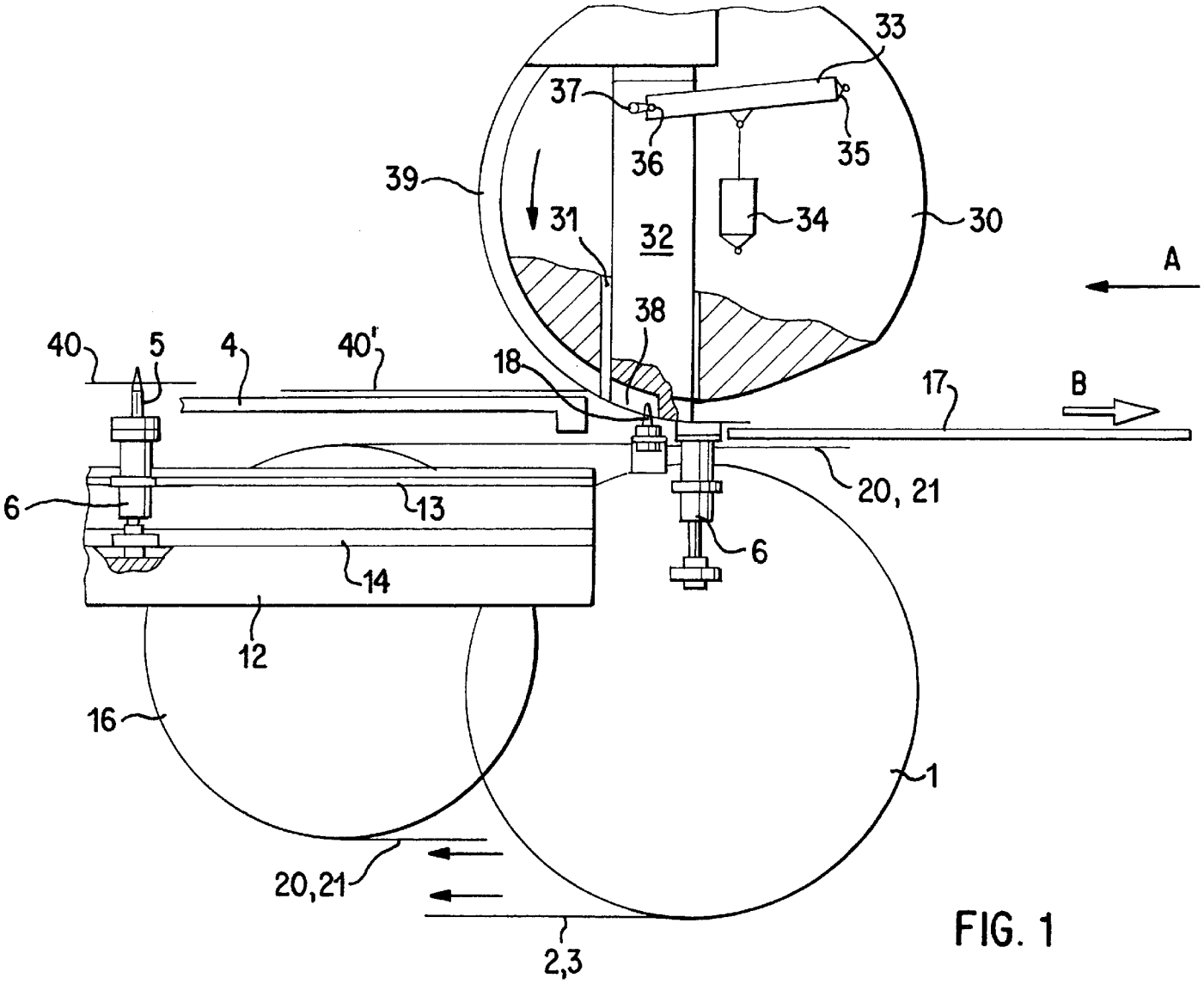
FIG. 1 is a side view of the transfer apparatus in a schematic representation.

In FIG. 1, there may be seen the chain guide wheel or a chain sprocket 1 at the outlet end of the first conveyor, which wheel is mounted in a frame, not shown, for rotation round a horizontal axis, and is provided in duplicate to correspond to the two conveyor chains 2, 3. The first conveyor has a table plate 4 fixed to the frame and provided with gaps extending in the conveyance direction. The pins 5 serving for the conveyance pass through these gaps. The pins 5 serving for the conveyance are carried for longitudinal displacement in bushes 6 that are secured to plates of the plate link chains 2, 3 by means of angle pieces 7. The rear ends 8 of the pins 5 passing through the bushes 6 carry disks 9 secured to the pins. The bushes are provided with collars 10. In the bushes, the pins 5 or their shanks pass through compression springs which bear at one end on annular shoulders of the bushes and at the other end on the disks secured on the shanks of the pins, in such a way that the pins are retracted into the bushes 6, for example, in the way shown in FIG. 2.

Beneath the table plate 4, are guides 12 arranged parallel to the table plate which guides are provided with grooves 13, 14 that are parallel to the table plate 4. In the entry zone, not shown, of the guides 12, the grooves 13, 14 diverge from each other in a wedge shape towards the inlet end; in this arrangement, the interspacing of the grooves in this entry zone corresponds to the interspacing of the disk 9 and the collar 10 in the state the pin 5 has when it is retracted into the bush 10. To ensure a proper insertion of the disks 9 and of the collars 10 into the grooves 13, 14, the grooves may, moreover, be additionally widened in a funnel shape towards their inlet end.

The guides collars 10 may have a U-shaped profile, so that the bushes 6 run partly in the U-shaped recess, and in this arrangement the grooves 13, 14 holding the pins in their extended position are arranged in the sides of the recess of the guide 12.

The chain guide wheel or the chain sprocket on the inlet end of the second conveyor which, corresponding to the two endless conveyor chains of the second conveyor, is also provided in duplicate, is disposed in the frame ahead of the outlet end chain wheels 1 of the first conveyor as viewed in the conveyance direction B, so that the sides of the two conveyors overlap one another. Of the second conveyor, only the chain wheel 16 on the inlet end has been represented, but not also the associated chain wheel on the outlet end. The conveyance plane of the second conveyor is also formed by a table plate 17 that is provided with longitudinal gaps in which the pins entraining the workpieces run. These pins 18 entraining the workpieces are secured by means of angle pieces 19 on plates of plate link chains 20, 21. The plate link chains 20, 21 run in guides 22, 23 which are fixed beneath the table plate 17 on supports 25 of the frame. The pins 18 have such a height that they pass through the table plate 17 in the gaps that are parallel to the conveyance sides of the chains 20, 21.

Figure 2:
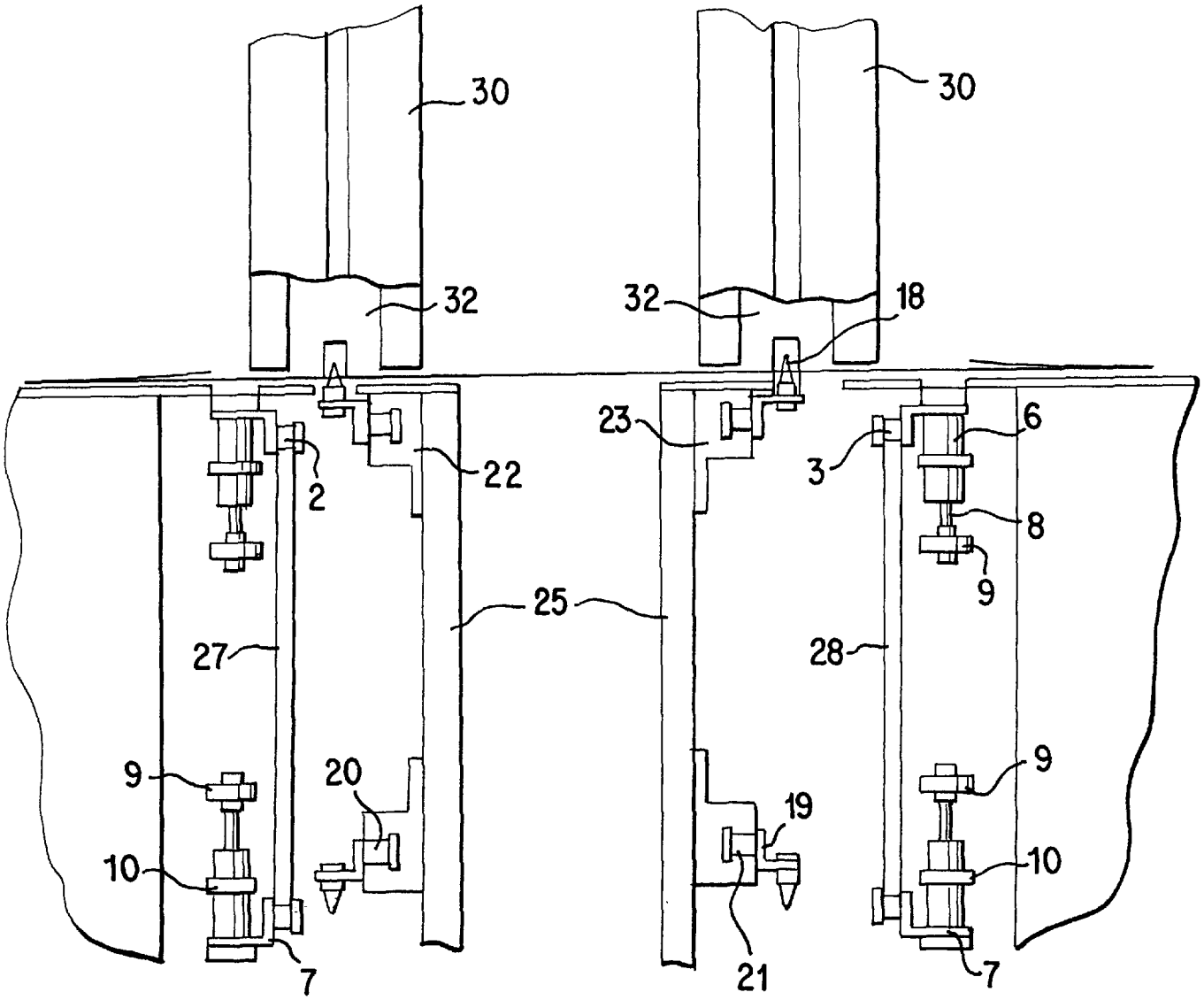
FIG. 2 is a view of the apparatus, as seen in the direction of arrow A in FIG. 1.

The chains 2, 3 of the first conveyor, whose top sides and bottom sides run on guides 27, 28 fixed to the frame, are offset relative to the sides of the endless conveyor chains 20, 21 of the second conveyor as is shown in FIG. 2.

In the transfer zone between the first conveyor and the second conveyor, thus behind the plate 4 in the conveyance direction, is a disk 30 arranged in the frame for rotation above the table plate 17 of the second conveyor. A plunger 32 is carried in this disk 30, for displacement in a support 31 disposed on a secant. The plunger 32 is displaceable to-and-fro by means of a pitman 33 which is pivoted by a pneumatic cylinder 34 whose cylinder is articulated in the disk 30 and whose piston rod is articulated on the pitman 33 in the way shown. One end 35 of the pitman 33 is articulated in the disk 30, while the front end of the pitman 33 engages in a slot 37 of the plunger 32, by means of an articulation pin 36. At its bottom end, the plunger 32 is provided with a groove-shaped recess 38. This groove-shaped recess is aligned with a circumferential groove 39 of the disk 30 which extends over a part of the circumference of the disk 30 in the manner shown in FIG. 1.

To correspond to the two conveying runs of the chains 20, 21 of the second conveyor which are provided with pins 18, the disk 30 mounted in the frame is provided in duplicate.

In the radially extended position of the plunger 32 shown in FIG. 1, its end side lies approximately in the circumferential zone of the disk 30, so that together with the groove 39, the recess 38 of the plunger 32 completes a substantially continuous channel.

The rotation of the disk 30 is synchronized with the conveyance speed of the second conveyor in such a way that the ends of the plungers 32 can then run over the conveyor surface 17 of the second conveyor just when the pins 18 serving for the conveyance pass therethrough.

In FIG. 1, there may be seen the front end of the sack workpiece 40 which is threaded on a pair of pins 5 of the first conveyor. In FIG. 1, there may, moreover, be seen the leading workpiece 40' at a time when its front end has just arrived over the table plate 17 and the plunger 32 has moved down for threading this workpiece on the pins 18.

From FIG. 1 also shows that at the time when the leading workpiece 40' is threaded onto the pins 18 of the second conveyor, the pins 5 of the first conveyor have released this workpiece by virtue of the bushes carrying the pins 5 having moved out of the guide 12 and its guide grooves 13, 14, and allowed the compression springs, not shown, to retract the pins 5 at a stroke into the bushes 6 during the movement out of the guide 12.

We claim:

1. An apparatus for transferring flat workpieces comprising:

a first conveyor having two pulling members circulating parallel to each other over guide wheels and which carry pairs of supporting elements with retractable pins;

a second conveyor having two pulling members also circulating parallel to each other over guide wheels and which also carry Pairs of supporting elements with pins;

at least one table plate defining a conveyance path;

guides extending parallel to the at least one table plate which receive attachments to the supporting elements and pins of the first conveyor, said guides displacing the attachments towards each other as they run past the guides to cause the pins to project above the conveyance path to perforate and convey the workpieces;

a plunger arranged in a transfer zone between said first conveyor and said second conveyor; and a support in which said plunger is mounted so as to be raised and lowered to impale the workpieces on the pins of the second conveyor as the workpieces are transferred through the transfer zone from the first conveyor.

2. An apparatus according to claim 1, wherein the supporting elements of the first conveyor are bushes in which the pins of the first conveyor are carried for axial displacement, wherein the attachments to the pins of the first conveyor are disks carried by rear ends of the pins of the first conveyor, and wherein the attachments to the pins are collars carried by the bushes, said disks and said collars being held in respective grooves defined in the guides in pushed together positions so that the guides project the pins above said conveyance path.

3. An apparatus according to claim 2, wherein said guides have intake zones provided with said grooves and wherein pairs of said grooves converge in a wedge shape.

4. An apparatus according to claim 2, wherein said guides have intake zones provided with said grooves and wherein pairs of said grooves converge in a wedge shape.

5. An apparatus according to claim 1, wherein the pulling members of said second conveyor are plate link chains and the supporting elements of said second conveyor are connected to the plate link chains by angle pieces.

6. An apparatus according to claim 5, wherein the plate link chains run in fixed guides.

7. An apparatus according to claim 6, wherein said guides are supporting rails.

8. An apparatus according to claim 1, and further comprising a rotating disk disposed above the workpieces passing through said transfer zone, wherein the plunger is mounted in said rotating disk.

9. An apparatus according to claim 1, and further comprising a pneumatic cylinder provided for raising and lowering the plunger.

10. An apparatus according to claim 1, wherein the plunger is provided with a recess into which the pins of the second conveyor can penetrate.

11. An apparatus according to claim 10, wherein the disk is provided, at least over a part of its circumference, with a groove which shares a common radial plane with the recess of the plunger.

12. An apparatus according to claim 1, wherein the first conveyor circulates intermittently and the second conveyor circulates continuously.

* * * * *